United States Patent [19]

Morofushi

[11] Patent Number: 4,866,256

[45] Date of Patent: Sep. 12, 1989

[54] TICKET ISSUING APPARATUS

[75] Inventor: Yoshikazu Morofushi, Shizuoka, Japan

[73] Assignee: Tokyo Electric Co., Ltd., Tokyo, Japan

[21] Appl. No.: 125,997

[22] Filed: Nov. 27, 1987

[30] Foreign Application Priority Data

Nov. 28, 1986 [JP] Japan ..... 61-283462

[51] Int. Cl.[4] ..... G06C 11/10

[52] U.S. Cl. ..... 235/433; 235/449; 360/2

[58] Field of Search ..... 360/2; 235/432, 433, 235/449

[56] References Cited

U.S. PATENT DOCUMENTS

| | | | |
|---|---|---|---|
| 3,703,628 | 11/1972 | Philipson | 235/432 |
| 4,025,956 | 5/1977 | Nozaki et al. | 360/2 |
| 4,106,062 | 8/1978 | Foote | 360/2 X |
| 4,278,879 | 7/1981 | Hofmann et al. | 360/2 X |
| 4,429,217 | 1/1984 | Hill et al. | 235/449 X |
| 4,494,127 | 1/1985 | King | 360/2 |
| 4,608,488 | 8/1986 | Hirose et al. | 235/449 X |
| 4,733,060 | 3/1988 | Dono et al. | 235/432 X |

FOREIGN PATENT DOCUMENTS 61-33575 2/1986 Japan .

*Primary Examiner*—David L. Trafton

*Attorney, Agent, or Firm*—Frishauf, Holtz, Goodman & Woodward

[57] ABSTRACT

A ticket issuing apparatus comprises a ticket stock having ticket containing portion for containing a plurality of tickets each of which has magnetic stripe, and ticket supply roller for leading out the tickets one by one, a conveyor for conveying the ticket from the stock, a magnetic head for recording a given data on the magnetic stripe of the ticket on the conveyer, a thermal head for printing on the ticket on the conveyer in accordance with the given data, a manual-insertion guide having at its one end an insertion opening into which a ticket is manually inserted from outside, the other end of which communicating with the conveyer, a side passage guide having at its one end a side opening communicating with the conveyer between the ticket stock and the magnetic head, and a control device for controlling the conveyer so as to move, at first, the ticket, inserted into the insertion opening of manual-insertion guide, through the conveyer into the side passage guide at the side opening, and, then, to move the ticket from the side passage guide into the conveyer so that the ticket is recorded the given data on its magnetic stripe by the magnetic head, and further is printed by the thermal head.

9 Claims, 9 Drawing Sheets

TICKET ISSUING APPARATUS

BACKGROUND OF THE INVENTION

This invention relates to a ticket issuing apparatus which magnetically records a given data to a ticket having a magnetic-record holding means, prints on it in accordance with the data, and issues it.

The ticket issuing apparatus described above is used for issuing, for example airline tickets. In this apparatus, tickets, which have not been magnetically recorded or printed, are piled up in ticket stock means located inside the apparatus. The piled-up tickets are drawn out one by one from the ticket stock mean to be supplied to magnetic recording means, such as a magnetic head, and printing means, such as a thermal head.

The magnetic recording means comprises magnetically writing means for writing or recording the given data in the magnetic-record holding means, such as a magnetic stripe, of the ticket, and magnetic-record monitoring means for monitoring a data written or recorded in the magnetic-record holding means. The data monitored by the monitoring means is compared with the given data.

The printing means prints on the ticket in accordance with the given data only when the monitored and the given data are the same.

In the conventional apparatus, when magnetic recording of the given data to a ticket, which has been discharged from the ticket issuing apparatus without printing by the printing means due to the inconsistency between the monitored data and the given data, is tried again, or when the data, which has been recorded on the ticket, is tried to be changed after the issuing of the ticket from the ticket issuing apparatus, and the printed data is tried to be amended in accordance with an amended-given data, these tickets must be placed on a new ticket located uppermost in the piled-up new tickets in the ticket stock means.

The uppermost new ticket in the piled-up new tickets, however, is pressed down by a ticket-supply roller for letting out the piled-up new ticket from the ticket stock means, and, further, the ticket stock means is covered by a cover member. Therefore, making the trial and the amendment described above is very troublesome, so that the ticket in question is frequently thrown out and a new ticket is issued in spite of making such works.

SUMMARY OF THE INVENTION

This invention has been developed under these circumstances described above and its object is to provide a ticket issuing apparatus which can make the works for making the trial and amendment to the tickets in question described above become easy, and can make the throwing out of the tickets in question and waste of new tickets decrease.

A ticket issuing apparatus for achieving the above object of the invention comprises ticket stock means having a ticket containing portion for containing a plenty of tickets, each of which has magnetic-record holding means and ticket supplying means for leading out the tickets one by one from the ticket stock means, conveying means for conveying the ticket led out from the ticket stock means, magnetic recording means having a magnetic head for writing or recording a given data on the magnetic-record holding means of the ticket conveyed by the conveying means, and printing means for printing on the ticket conveyed by the conveying means in accordance with the given data.

The ticket issuing apparatus is characterized by further comprising manual-insertion passage means having at its one end an insertion opening into which a ticket is manually inserted from outside, the other end of which communicates with the conveying means, and side passage means having at its one end a side opening communicating with the conveying means between the ticket stock means and the magnetic recording means. In the apparatus, the conveying means is controlled by control means so that a ticket manually inserted into the insertion opening of the manual-insertion passage means from outside is at first introduced through the conveying means into the side passage means by the side opening, and then the ticket is moved from the side passage means to the conveying means so that the given data is written or recorded on the magnetic-record holding means by the magnetic recording means and is printed by the printing means.

In the ticket issuing apparatus of this invention characterized by the construction described above, it is preferable that gate means is provided in each of the other end of the manual-insertion passage means and in the side opening of the side passage means, the gates means being movable between a closed position in which the gate means closes the other end or the side opening and an opening position in which the gate means opens the other end or the side opening to the conveying means. The gate means provided in the other end of the manual-insertion passage means is urged toward the closed position, and, at the opening position, the guide means guides the ticket inserted in the manual-insertion passage means into the conveying means so that the ticket is directed to the side opening. The guide means in the side opening of the side passage means is urged toward the opening position, and, at the opening position, guides the ticket, moved from the manual-insertion passage means to the conveying means, into the side opening of the side passage means.

Such gate means surely prevents a new ticket, conveyed in the conveying mean from the ticket stock means, from being introduced into the side passage means or the manual-insertion passage means through the other end or the side opening. The gate means also surely prevents the ticket in question inserted in the manual-insertion passage means from being guided by the conveying means toward a portion, for example the ticket stock means or the printing means, except for the side passage means.

In the ticket issuing apparatus of this invention characterized by the construction described above, it is preferable that the manual-insertion passage means comprises insertion sensing means for sensing the insertion of a ticket from outside to the insertion opening, sensing means for sensing the magnetic-record holding means of the ticket inserted into the insertion opening, a closing lever being movable between a closed position, in which the lever is located in the manual-insertion passage defined in the manual-insertion passage means and collides with the ticket inserted in the manualinsertion opening to prevent the ticket from further introducing into the manual-insertion opening, and an opening position, in which the lever is moved away from the manual-insertion passage to allow the further introduction of the ticket inserted into the manual-insertion opening into the manual-insertion opening, and closinglever drive means for moving the closing lever to the opening position in accordance with the sensing of the magnetic-record holding means of the ticket; inserted into the manual-insertion opening, by means of the sensing means for the magnetic-record holding means. With this construction, several elements, such as the magnetic recording means and the printing means, housed in the ticket issuing apparatus are prevented from being destroyed by introducing something, except for a predetermined ticket having magnetic-record holding means, through the manual-insertion passage means into the conveying means.

Figure 1:
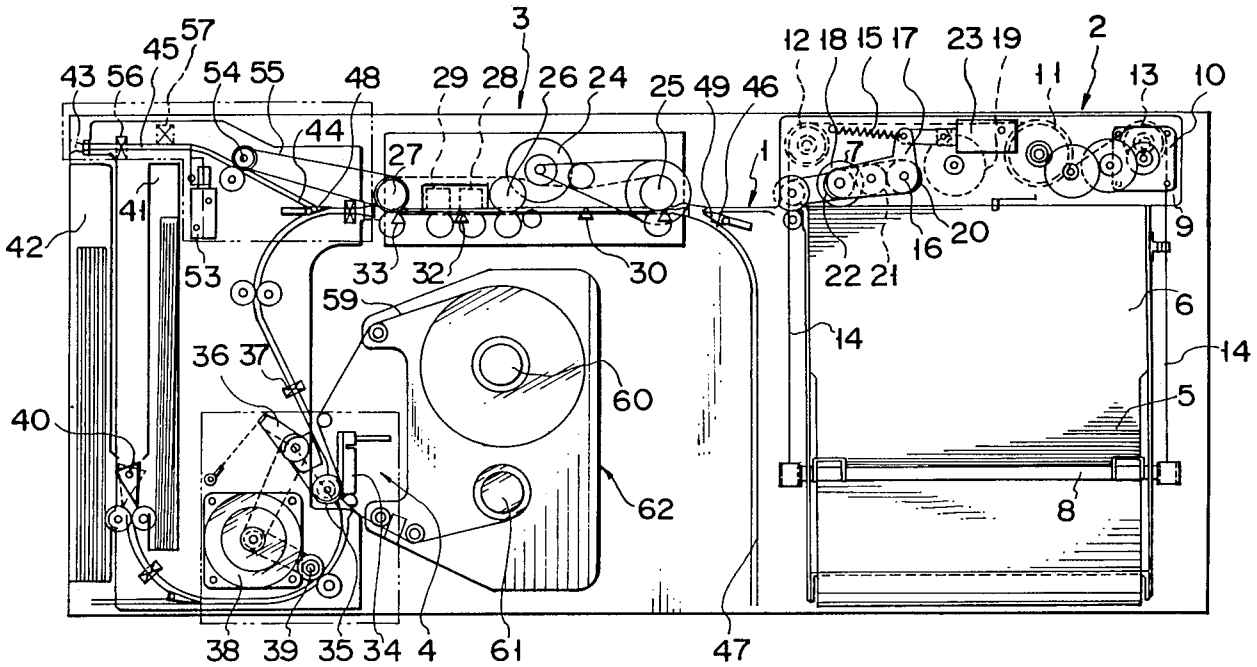
FIG. 1 is a vertical view schematically showing a ticket issuing apparatus according to one embodiment of this invention.

One embodiment of this invention will be described in detail with reference to the accompanying drawings.

DETAILED DESCRIPTION OF THE PREFERRED EMBODIMENTS

Reference numeral 1 designates a guide for defining conveying passage of conveying means. Ticket stock means 2 is located at one end of guide 1, and magnetic recording means 3 and printing means 4 are located along guide 1 between one end and the other end thereof. Ticket stock means 2 has containing portion 6, in which a plurality of tickets 5 are piled up to be stocked therein, and paper supply means 7 for leading out tickets 5 one by one in order from the uppermost one from containing portion 6 to the one end of guide 1.

Containing portion 6 has elevating plate 8 provided in frame 9 so as to be movable upward and downward and on which the plurality of tickets 5 are piled up. Take-up drum 11 driven by bi-directional motor 10, and a pair of pulleys 12 and 13 are supported by the upper end portion of frame 9, and a pair of ropes 14, which are fixed, at one end, to both ends of elevating plate 8, are guided by pulleys 12 and 13 toward take-up drum 11. Ropes 14 are, and at its other end, fixed to take-up drum 11.

Paper supply means 7 has arm 17 provided at the upper end portion of frame 9 so as to be rotatable around shaft 16 and urged by spring 15 toward uppermost ticket 5 in containing portion 6, paper-supply roller 18 rotatably supported by arm 17 and pressed on uppermost ticket 5 in containing portion 6, motor 19 held at the upper end portion of frame 9, a plurality of gears 20, 21, 22 rotatably supported by arm 17 so as to transmit rotation of the output shaft of motor 19 to paper-supply roller 18, and plunger.solenoid drive means 23 provided at the upper end of frame 9 so as to be connected to arm 17. In the above construction, since gear 20 is supported by shaft 16 which functions as rotational center of arm 17, gear 20 keeps its connection to the output shaft of motor 19 even if arm 17 is rotated around shaft 16.

Ticket 5 is an airline ticket on the outside surface of which various predetermined matters have been printed and on the backside surface of which magnetic stripe **5*b* as magnetic-record holding means is provided. Ticket 5 is substantially rectangular, and magnetic stripe 5*b* extends in the longitudinal direction of ticket 5. Ticket 5 is placed on elevating plate 8, with its backside surface turned upward, parallel with the extending direction of the one end of guide 1**.

Figure 5:
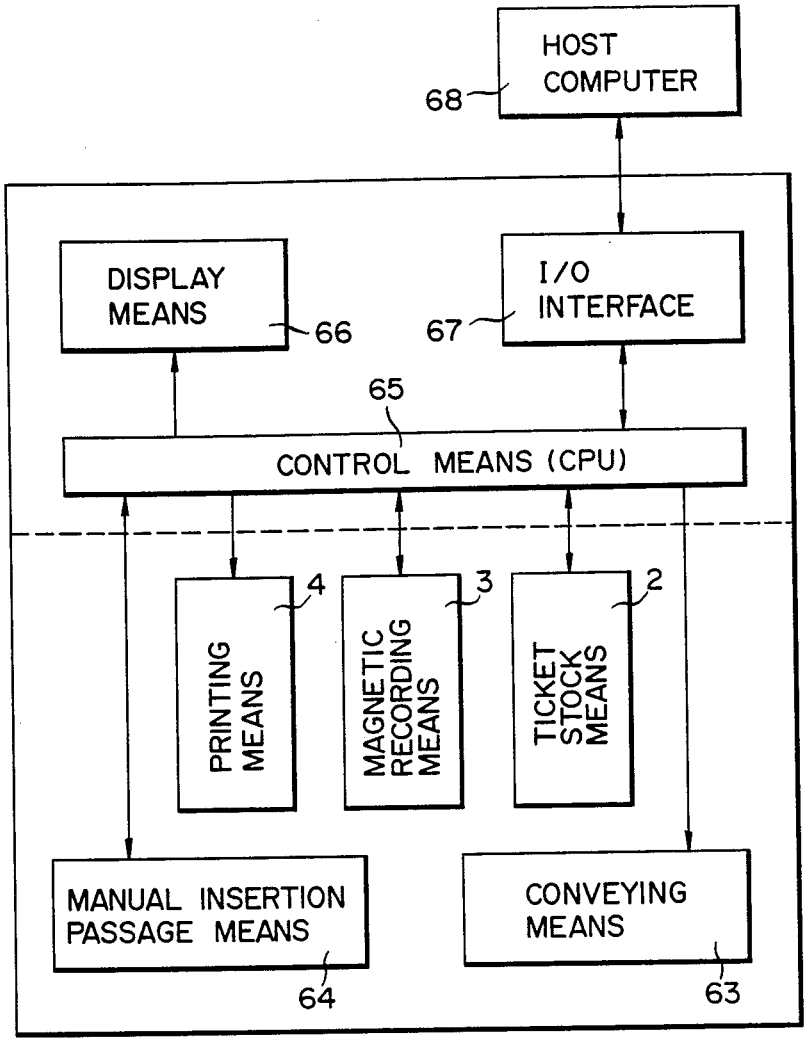
FIG. 5 is a block diagram showing control means in the ticket issuing apparatus in FIG. 1.

In magnetic recording means 3, pairs of conveying rollers 25, 26, and 27 driven by bi-directional motor 24 are located along guide 1. Motor 24 and conveying rollers 25, 26, and 27, and guide 1, constitute conveying means 63 (FIG. 5).

Magnetic recording means 3 has magnetic head 28 for writing or recording located along guide 1 between the pair of conveying rollers 26, located in the middle courses with respect to conveying direction of ticket 5 on guide 1 in magnetic recording means 3, and the pair of conveying rollers 27, located at the downstream. Magnetic recording means 3 further has monitoring magnetic head 29 located along guide 1 at the downstream side of writing or recording magnetic head 28. Magnetic recording means 3 also further has light-reflection type sensors 30, 32, and 33 which are located along guide 1 between the pair of upstream conveying rollers 25 and the pair of middle-course conveying rollers 26, between a pair of magnetic heads 28 and 29, and at upstream of the pair of downstream conveying rollers 27.

Printing means 4 has thermal head 34 located along guide 1, arm 36 which is located opposite side of guide 1 with respect to thermal head 34 so as to be rotatable, arm 36 rotatably holding platen 35 and being urged to approach platen 35 toward thermal head 34, and ligh-reflection type sensor 37 located along guide 1 at the entrance of printing means 4.

Conveying means 63 further has a pair of conveying rollers 39 located along guide 1 at downstream of printing means 4, and the pair of conveying rollers 39 is driven by motor 38 for driving platen 35.

Direction change lever 40 having triangular shape is rotatably mounted in the exit of guide 1 with is one peak oriented toward the upstream of guide 1, and ticket issuing opening 41 and void-ticket collecting opening 42 are located at both sides of lever 40.

The ticket issuing apparatus according to one embodiment of this invention further has manual-insertion passage means 45 having at its one end insertion opening 43, into which ticket 5 is inserted from outside, and being communicated at its other end 44 with guide 1 of conveying means. The other end 44 of manual-insertion passage means 45 opens toward the upstream side of guide 1 (that is, toward magnetic recording means 3) at downstream of magnetic recording means 3.

The ticket issuing apparatus according to the one embodiment of this invention further has side-passage guide 47 having, at its one end, opening 46 communicated with guide 1 of conveying means between ticket stock means 2 and magnetic recording means 3.

Gates 48 and 49 are provided in the other end 44 of manual-insertion passage guide 45 and side opening 46 of side-passage guide 47, respectively. Gates 48 and 49 can rotates between opening position in which they open the other end 44 and side opening 46 to guide 1, and closed position in which they close the other end 44 and side opening 46 to guide 1. Gates 48 and 49 are respectively located at the closed position and the opening position, due to weight balance thereof.

Figure 2:
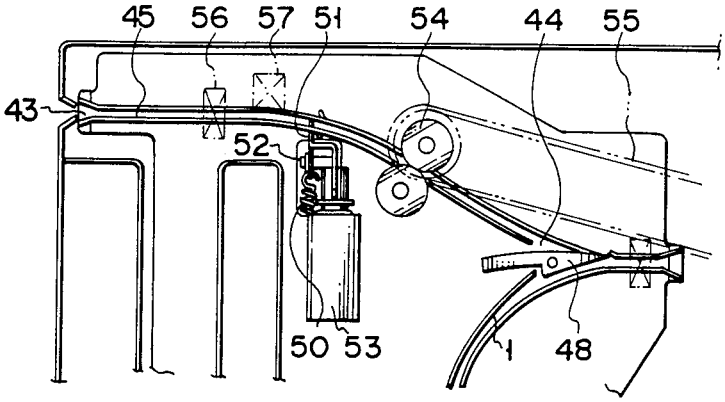
FIG. 2 is an enlarged vertical sectional view schematically showing circumference of manual-insertion passage means of the ticket issuing apparatus in FIG. 1.
Figure 3:
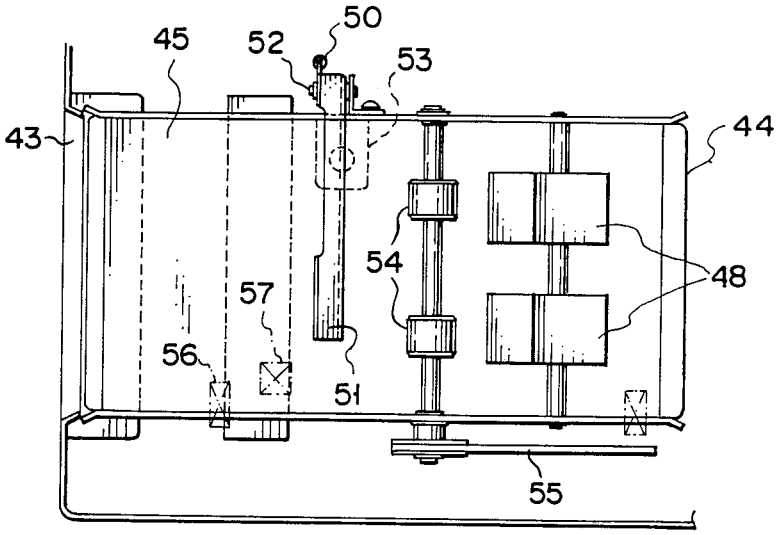
FIG. 3 is an enlarged plan view schematically showing circumference of the manual-insertion passage means in FIG. 2.
Figure 4:
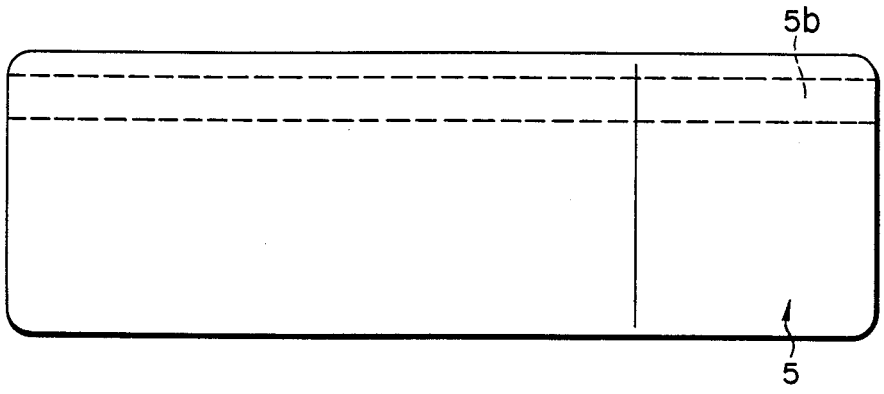
FIG. 4 is a plan view schematically showing a ticket used in the ticket issuing apparatus in FIG. 1.

As shown in FIGS. 2 and 3, one end portion of closing lever 51 is rotatably attached by shaft 52 at the side portion of manual-insertion passage guide 45. Closing lever 51 is rotatable around shaft 52 as the center of rotation between closed position, in which the other end of lever 51 projects into the manual-insertion passage defined by manual-insertion passage guide 45, and opening position, in which the other end of lever 51 is moved away from the manual-insertion passage. Spring 50 for urging closing lever 51 toward the closed position and plunger-solenoid drive means 53 are connected to closing lever 51, and spring 50 and plunger-solenoid drive means 53 construct closing-lever driving means.

A pair of conveying rollers 54 is provided in manual-insertion passage guide 45. The pair of conveying rollers 54 are connected through power transmitting belt 55 to the pair of conveying rollers 27 located in magnetic recording means 3. Sensor 56 for optically sensing ticket 5 inserted in manual-insertion opening 43, and magnetic sensor 57 for sensing magnetic stripe 56 provided on ticket 5 inserted into manual-insertion opening 43 are provided in the neighborhood of manual-insertion opening 43.

These sensors 56 and 57, closing lever 51, the pair of conveying rollers 54, and closing-lever driving means constitute manual-insertion passage means 64 (FIG. 5).

Printing means 4 has ribbon cassette 62 located beside thermal head 34, and supply shaft 60 and take-up shaft 61 both of which printing ribbon 59 is wound around are housed in ribbon cassette 62. Printing ribbon 59 extends o thermal head 34 along guide 1 between supply and take-up shafts 60 and 61.

As shown in FIG. 5, conveying means 1, having pairs of conveying rollers 25, 26, 27 and 39 located along guide 1, and motors 24 and 28 for driving the conveying rollers, is electrically connected to well known control means (CPU) 65. Control means 65 is also electrically connected to ticket stock means 2, magnetic recording means 3, printing means 4, and manual-insertion passage means 64, having optical sensor 56, magnetic sensor 57, and the pair of conveying rollers 54, and these three members of means 64 located along manual-insertion passage guide 44. Well known display means 66 and I/0 interface 67 are electrically connected to control means 65, and I/0 interface 67 is further electrically connected to HOST computer 68.

In the ticket issuing apparatus according to one embodiment of the invention, constructed as described above, paper-supply roller 18 is rotated by motor 19 of ticket stock means 2. Roller 18 feeds out a ticket 5, located uppermost in the bundle of plurality of tickets 5 in ticket stock means 2, in guide 1 toward magnetic recording means 3. At this time, the gate 49 provided in side opening 46 is located in its opening position due to its weight balance. Therefore, the ticket conveying passage defined in guide 1 is closed by gate 49, and ticket 5 led out from ticket stock means 2 abuts against gate 49 and advances in guide 1 with moving gate 49 from the opening position to the closed position.

Ticket 5 reached at magnetic recording means 3 is conveyed toward printing means 4 in magnetic recording means 3 by the pairs of conveying rollers 25, 26, and 27 in magnetic recording means 3. In such advance, when sensor 32 senses the leading end of ticket 5, control means (CPU) 65 shown in FIG. 5 is received a sensing signal from sensor 32 and operates magnetic head 28 to write or record magnetically a data from HOST computer 68 shown in FIG. 5 on magnetic stripe 5*b* of ticket 5. Monitoring magnetic head 29 is also operated by control means 65 to monitor a data written or recorded on magnetic stripe 5*b* of ticket 5 by magnetic head 28. In control means 65, the data monitored from magnetic stripe 5*b* of ticket 5 is compared with the data from HOST computer 68. When the two data described above are the same ticket is advanced from magnetic recording means 3 to printing means 4.

When the rear end of ticket 5 passes sensor 33 located at the rear end of magnetic recording means 3, the leading end of ticket 5 has reached at a position between thermal head 34 and platen 35. In response to a rear-end sensing signal from sensor 33, control means 65 operates plunger-solenoid drive means (not shown) connected to arm 36 of printing means 4 to rotate arm 36 so that platen 35 approached thermal head 34. Therefor, platen 35 presses the leading end of ticket 5 and printing ribbon 59 on thermal head 34, with the leading end and printing ribbon 59 overlapping. Ticket 5, together with printing ribbon 59, is moved on thermal head 34 by the rotation of platen 35, and control means 65 operates thermal head 34 to print o the outside surface of ticket 5 in accordance with the data from HOST computer 68.

Ticket 5 which has been printed out is further advanced in guide 1 by a pair of conveying rollers 39 located downstream of printing means 4. Printed-out ticket 5 is, then, guided toward ticket issuing opening 42 by direction change lever 40 urged by urging means to turn its one top which is located at the final end side of guide 1 toward void-ticket collecting opening 41.

When the data monitored from magnetic stripe 5*b* of ticket 5 by monitoring magnetic head 29 is different from the data given from HOST computer 68, control means 65 operates motor 24 must that the output shaft of motor 24 rotates in the reverse direction to move ticket 5 backward along guide 1 in magnetic recording means 3. Ticket 5 in question moved backward is prevented from entering into ticket stock means 2 and is introduced through side opening 46 into side-passage guide 47 by gate 49 located at the opening position due to its weight balance.

When the leading end of ticket 5 entered in side-passage guide 47 is sensed by sensor 30, control means 65 operates motor 24 to rotate in normal direction so that ticket 5 in question is moved from side-passage guide 47 to magnetic recording means 3. During this movement, magnetic head 28 again writes or records the data from HOST computer 68 on magnetic stripe 5*b* of ticket 5. Monitoring magnetic head 29 monitors the data written (that is, recorded) on magnetic stripe 5*b* of ticket 5 and compares the above data with the host computer input data. If the two data are the same, ticket 5 in question is moved from magnetic recording means 3 toward printing means 4 and ticket issuing opening 42.

If the two data are not the same again, ticket 5 is introduced in and moved out of side-passage guide 47, and the data from HOST computer 68 is again recorded on magnetic stripe 5b of ticket 5.

If the above two data are not found to be identical after ticket 5 has been reciprocally moved between magnetic recording means 3 and side-passage guide 47 a predetermined times (in this embodiment, 3 times), ticket 5 is regarded as void by control means 65. Ticket 5 is moved through printing means 4 toward the final end of guide 1. At this time, thermal head 34 of printing means 4 does not operates, and direction change lever 40 located at the final end of guide 1 is rotated by plunger-solenoid drive means not shown to move its one top facing the final end toward ticket issuing opening 42, as shown by dot-line in FIG. 1. Direction change lever 40 introduces ticket 5 into void-ticket collecting opening 41. After this, new ticket 5 is let out from ticket stock means 2 to magnetic recording means 3. The data, which can not be written or recorded on ticket 5 in question, is written or recorded on magnetic stripe 5b of new ticket 5.

In this embodiment, when three new ticket 5 led out successively from ticket stock means 2 toward magnetic recording means 3 are all determined as void, display means 66 shown in FIG. 5 displays a message showing the trouble of magnetic recording means 3.

In order to change the data recorded in magnetic stripe 5b of ticket 5 issued from the ticket issuing apparatus, and to change the data printed on the outside surface of ticket 5, ticket 5 is manually inserted into insertion opening 43 of manual-insertion passage guide 45, with magnetic stripe 5b turned upward. Insertion of ticket 5 into insertion opening 43 is sensed by optical sensor 56. Magnetic sensor 57 checks whether ticket 5 inserted into insertion opening 43 has magnetic stripe 5b or not. In response to a magnetic-stripe sensing signal from magnetic sensor 57 control means 65 operates plunger-solenoid drive means 53, thereby moving closing lever 51 from the closing position to the opening position. At the same time operates motor 24 so as to rotate 3 pairs of conveying rollers 27, 26 and 25 located in magnetic recording means 3 in the reverse direction (unticlockwise direction in FIG. 1). Reverse directional rotation of conveying roller 27, which is located at the downstream end in recording means 3 is, transmitted to the pair of conveying rollers 54 located along manual-insertion passage guide 45. The pair of conveying rollers 54 moves ticket 5 toward gate 48 located at the other end 44 in manual-insertion passage guide 45. Ticket 5 driven by the pair of conveying rollers 54 abuts against gate 48 urged to closed position by its weight balance, and moves gate 48 from the closed position to the opening position. Gate 48 located at the opening position guides ticket 5, advances from manual-insertion passage guide 45 toward magnetic recording means 3 in guide 1. Ticket 5 moved from manual-insertion passage guide 45 to magnetic recording means 3 is further advanced toward ticket stock means 2 in guide 1 by the 3 pairs of conveying rollers 27, 26 and 25 rotated in reverse direction in magnetic recording means 3. It is finally introduced into side passage guide 47 by normally-open type guide 49.

Figure 6:
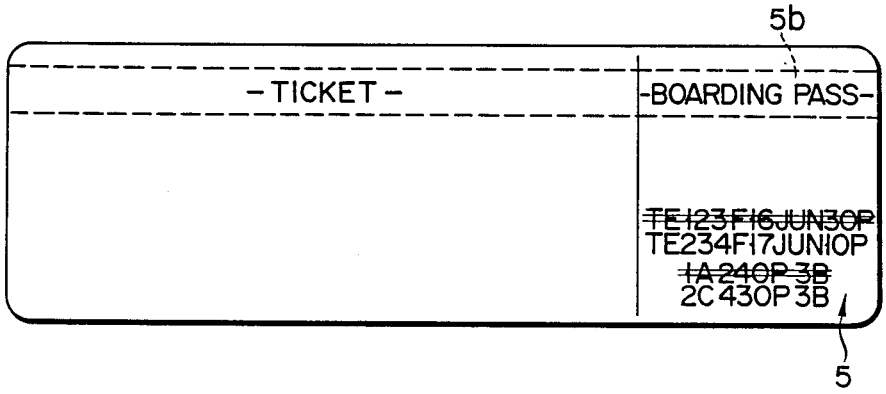
FIG. 6 is a plan view schematically showing a ticket whose printed contents has been amended in the ticket issuing apparatus in FIG. 1.

When sensor 30 detects the leading end of ticket 5 introduced into side passage guide 47, control means 65 operates motor 24 so as to rotate 3 pairs of conveying rollers 25, 26 and 27 in the normal direction (clockwise direction in FIG. 1). As a result of this, ticket 5 located in side-passage guide 47 is moved toward magnetic recording means 3, and the data is changed or amended, written or recorded on magnetic stripe 5b by in magnetic recording means 3. Processes performed on magnetic stripe 5b of ticket 5 supplied from side-passage guide 47, in magnetic recording means 3, and processes performed on magnetic stripe 5b of new ticket 5 led out from ticket stock means 2 are the same. If the changed or amended data on magnetic stripe 5b is identical with the data supplied from HOST computer 68, ticket 5 is conveyed toward printing means 4. The data printed on the outside surface of ticket 5 is changed or amended in accordance with the changing or amending data, and ticket 5 is discharged into ticket issuing opening 42. FIG. 6 shows ticket 5 bearing the data printed on the outside surface and changed or amended in accordance with the data supplied from HOST computer 68, wherein a flight and a seat reservation number printed at a boading-pass portion on the outside surface of ticket 5 are changed or amended.

Figure 7A:
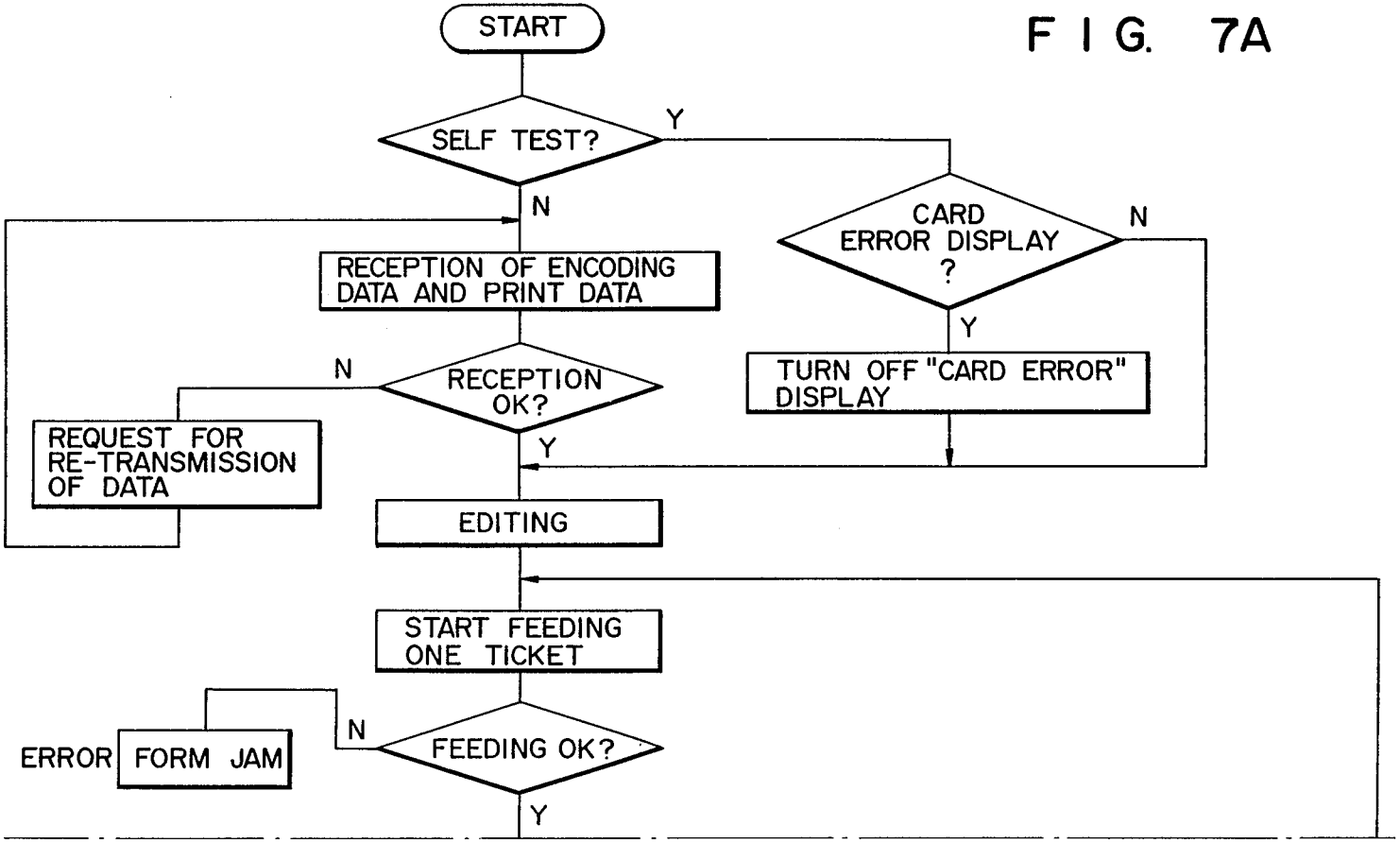
FIGS. 7A and 7B are flow charts schematically showing flow of usual process in the ticket issuing apparatus when a new ticket is supplied from ticket stock means in the ticket issuing apparatus.
Figure 7B:
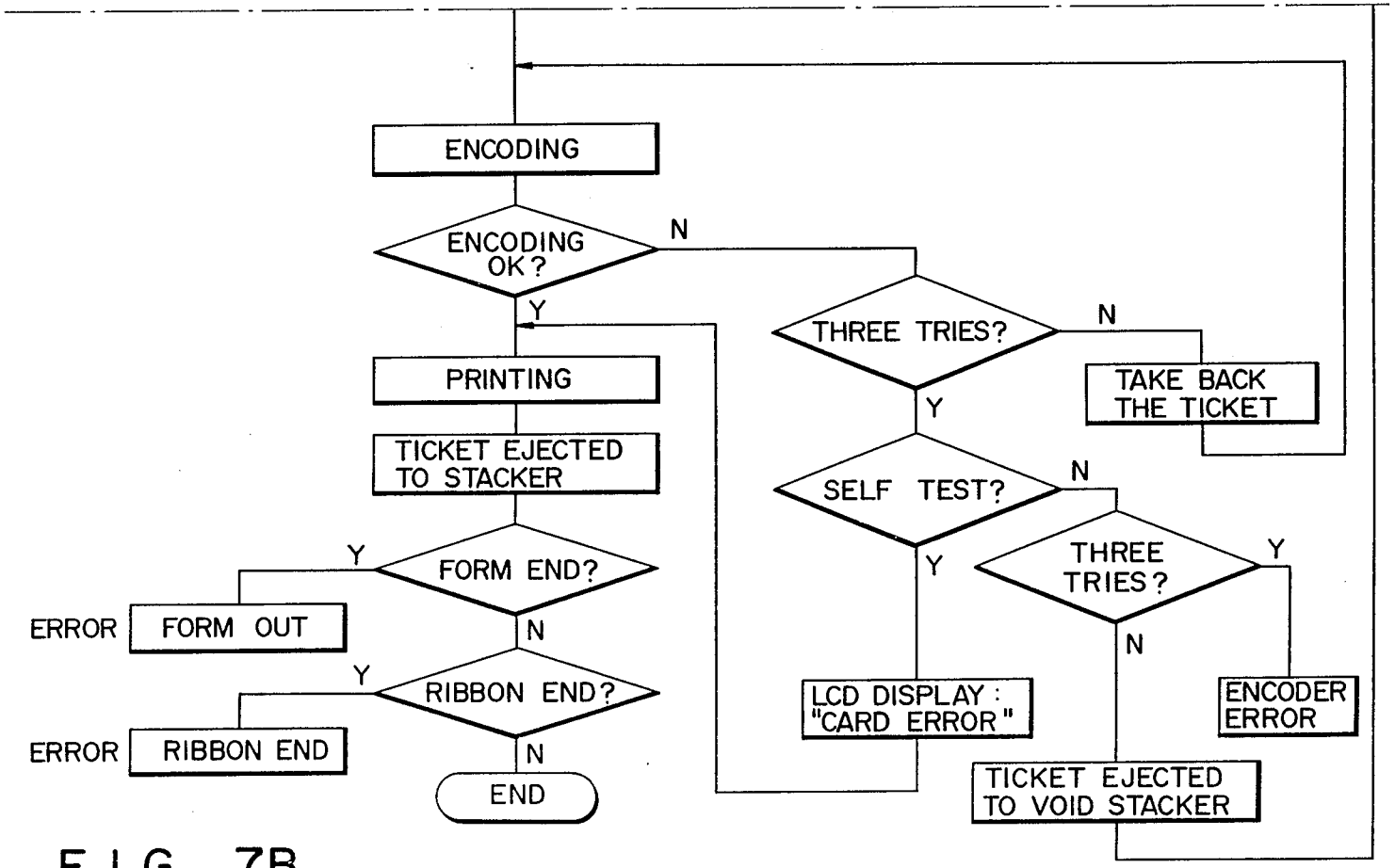

FIGS. 7A and 7B are flow charts schematically showing flow of usual process in the ticket issuing apparatus when new ticket 5 is supplied from ticket stock means 2 in the ticket issuing apparatus.

Figure 8A:
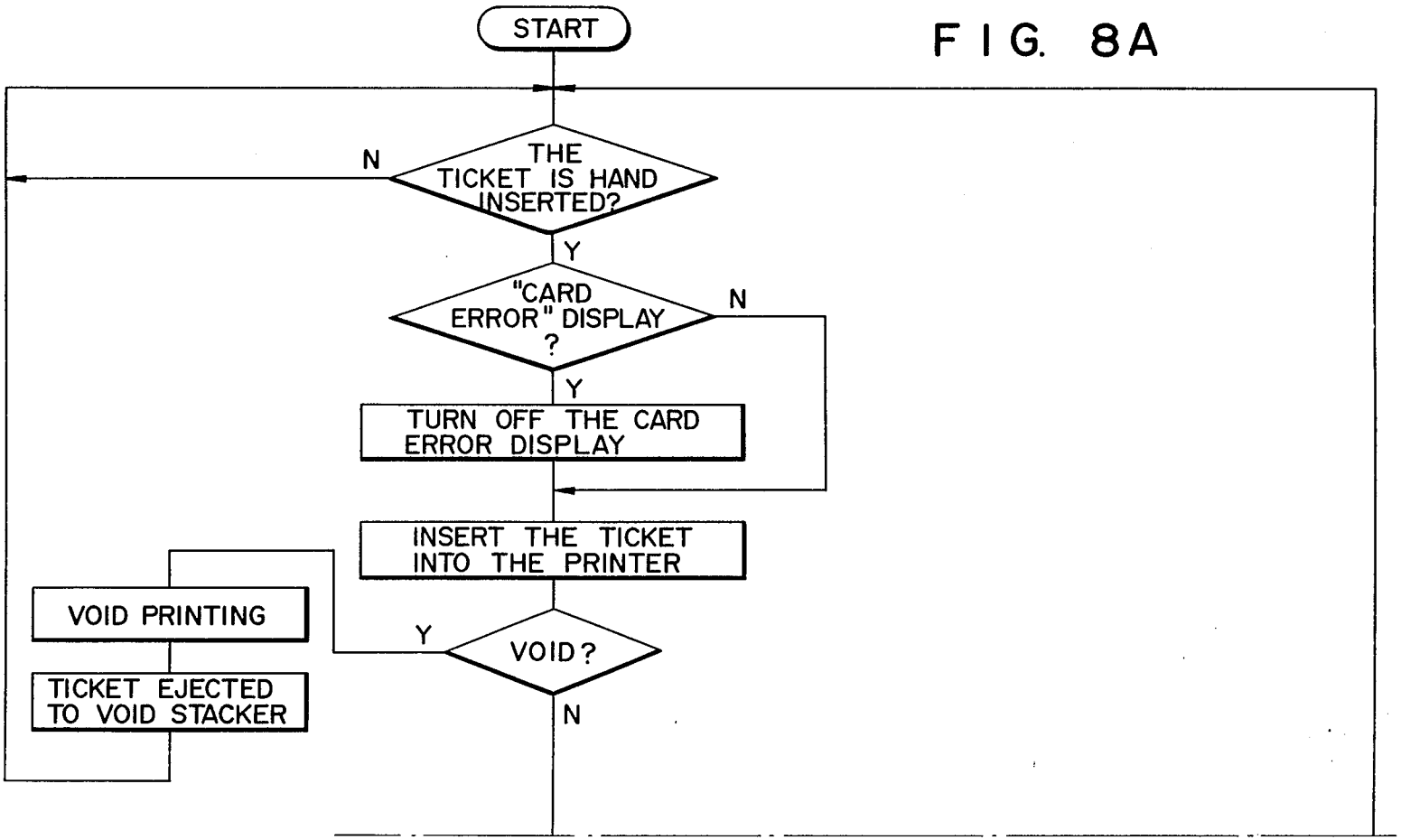
FIGS. 8A, 8B, and 8C are flow charts schematically showing flow of the unusual process in the ticket issuing apparatus when a ticket to be amended is led from the manual-insertion opening of the manual-insertion passage means into the ticket issuing apparatus.
Figure 8B:
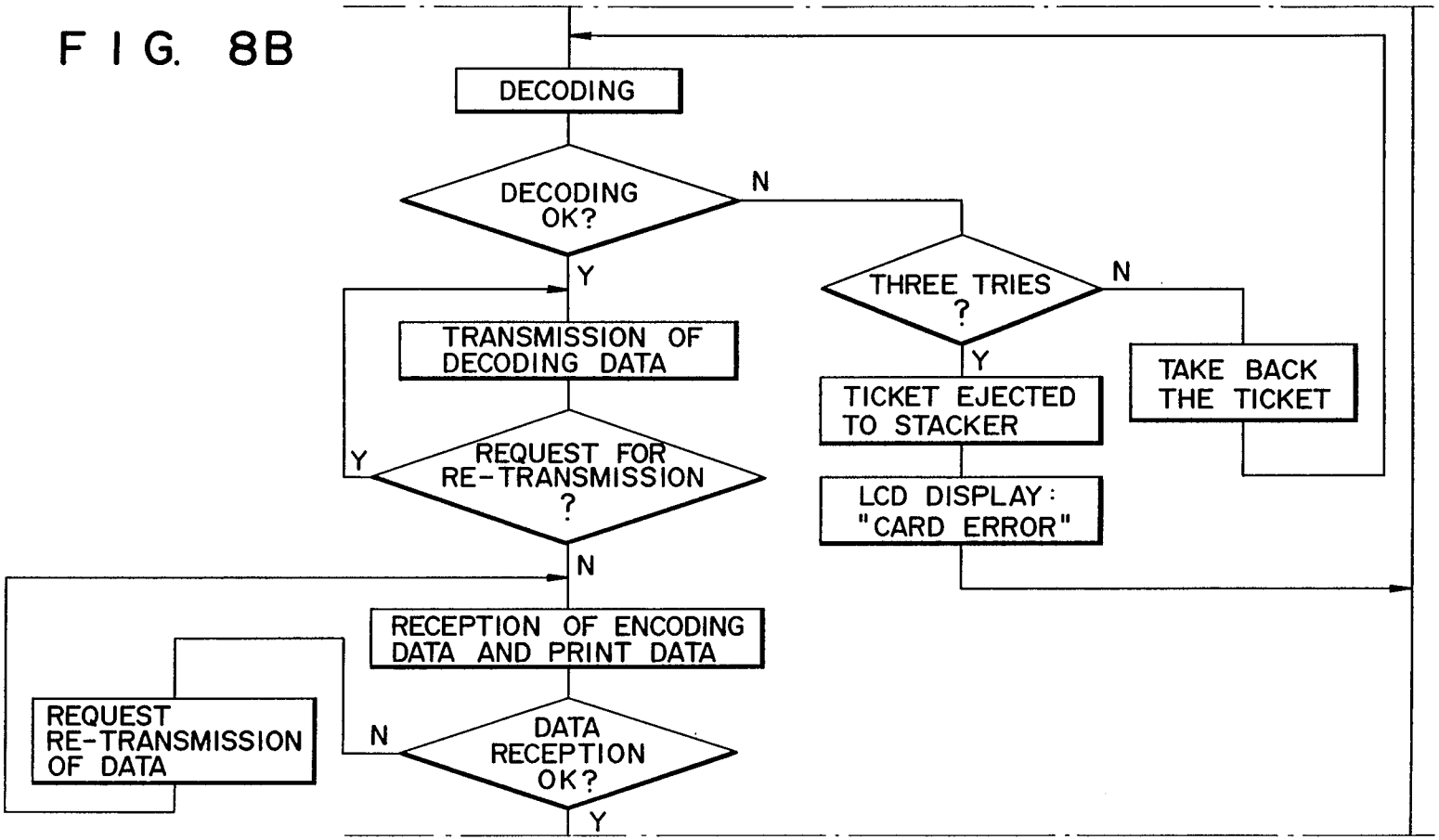
Figure 8C:
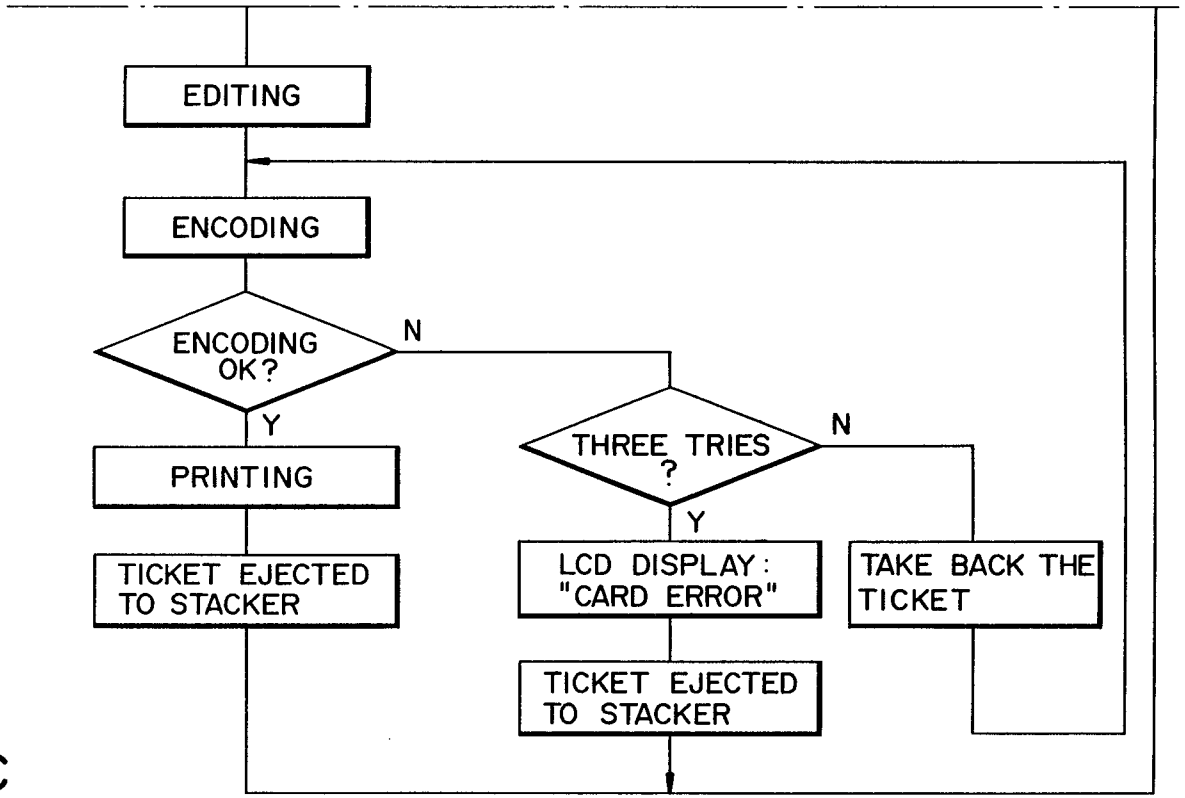

FIGS. 8A, 8B, and 8C are flow charts schematically showing flow of unusual process in the ticket issuing apparatus when ticket 5 to be amended is led from the manual-insertion opening 43 of the manual-insertion passage means 45 into the ticket issuing apparatus.

As shown in FIGS. 7A and 7B, when flow of the usual process in the ticket issuing apparatus starts, whether a self test is need or not is judged at first. If the self test is carried out, whether "card error" being displayed or not is judged. In a case that "card error" being displayed, this display is turned off. If the self test is not carried out, control means 65 receives an encoding data and printing data from HOST computer 68. When reception of the data described above is finished, then a data editing starts. But reception of data has not finished, request for re-transmission of data is sent to Host computer 68. In a case that "self test" is carried out, the data editing starts after finish of "self test".

When the data editing is finished, then new ticket is led out from ticket stock means 2. After checking of the feeding of ticket 5, magnetic head 28 in magnetic recording means 3 encodes or records the data from Host computer 68 on magnetic stripe 5b of ticket 5 When ticket feeding is troubled, error processing for FORM JAM is carried out.

If it is found that the data from Host computer 68 and the encoded or recorded data on magnetic stripe 5b of ticket 5 are the same, resulting from a check of the encoded or recorded data by using monitoring magnetic head 29, ticket 5 is advanced by conveying means 63 from magnetic recording means 3 to printing means 4. Printed ticket 5 is rejected out from the distal end of conveying guide 1 and guided by direction change lever 40 to ticket issuing stacker or opening 42.

After issuing ticket, whether ticket stock means contains ticket 5 or not is checked, and whether ink ribbon 59 in ribbon cassette 62 is used up or not is also checked. If ticket stock means 2 does not contain ticket 5, process for FORM OUT error is carried out. And, if ink ribbon 59 in ribbon cassette 62 is used up, process for RIBBON END is carried out.

If it is found that the data from HOST computer 68 and the data on magnetic stripe 5b of ticket 5 are not the same, resulting from a check of the encoded or recorded data by using monitoring magnetic head 29, such an encoding or recording, ticket 5 is checked three times until consistency between the two data is gained.

After that consisting between the two data is gained in three tries of the encoding or recording, and checking process described above, whether "self test" is need or not is judged. When the "self test" is carried out, display means 66, such as LCD, displays "CARD ERROR", and then ticket 5 is advanced to printing means 4 to be printed in accordance with the print data from HOST computer 68.

In case that consisting between the two data is not gained in three tries of the encoding or recording, and checking process described above, "self test" is not carried out, and then ticket 5 is advanced through printing mean 4 to the final end of conveying guide 1 without being printed by printing means 4. Ticket 5, to which the data from HOST computer 68 can not be rightly encoded or recorded by magnetic recording means 3 and which is not printed by printing means 4, is guided by direction changing lever 40 at the final end so as to be ejected into VOID stacker, or void-ticket collection opening 41. In this case, new ticket 5 is led out from ticket stock means 2 to magnetic recording means 3.

When "self test" to ticket 5, which can not get consisting between the two data in three times of the encoding or recording, and checking process, is not successively carried out three times, that is, when the data from HOST computer 68 can not be rightly decoded or recorded by magnetic recording means 3 on all three tickets 5 successively led out from ticket stock means 2 to magnetic recording means 3, ENCODER ERROR process is carried out.

As is shown in FIGS. 8A, 8B, and 8C, when flow of the unusual process in the ticket issuing apparatus starts, whether ticket 5 is inserted through insertion hole 43 into hand-insertion passage guide 44 or not is judged at first by sensor 56 and magnetic sensor 57. Then, whether "CARD ERROR" is displayed or not is judged. In a case that "CARD ERROR" is displayed, ticket 5 is further advanced into the apparatus after turning off the "CARD ERROR" display. In a case that "CARD ERROR" is not displayed, ticket 5 is further advanced into the apparatus without being any processed.

To further-advanced void ticket 5, whether "VOID" process is carried out or not is judged. When "VOID" process is carried out, ticket 5 is advanced to printing means 4 to be printed with "VOID", and then ejected to VOID stacker, that is void-ticket collecting opening 41.

When "VOID" process is not carried out, decoding or reading out the data from magnetic stripe **5*b* of ticket 5** is carried out. The decoding or reading out can be tried again by three times.

When the decoding or reading out can not be carried out in the three tries of try, ticket 5 in question is ejected to "VOID" stacker, that is void-ticket collecting opening 41, and display means 66 displays "CARD ERROR".

The data decoded or read out from magnetic stripe **5*b* of ticket 5 is transmitted to HOST computer 68. If there is no request for re-transmission of the decoding or reading out data from HOST computer 68, Host computer 68 transmits a new data for newly encoding or recording on magnetic stripe 5*b* of ticket 5. When there is no request for re-transmission of the new data to HOST computer 68, editing of the new data is carried out so as to newly encode or record the new data on magnetic stripe 5*b* of ticket 5 in question and to print on the outside surface of ticket 5** in question in accordance with the new data.

The following process followed from the data editing step is the same as that of the normal process which has been described with reference to FIGS. 7A and 7B.

What is claimed is:

1. A ticket issuing apparatus comprising:

ticket stock means having a ticket containing portion for containing a plurality of tickets each having magnetic-record holding means, and ticket supplying means for leading out the tickets one by one from the ticket containing portion;

conveying means for conveying the ticket led out from the ticket stock means;

magnetic recording means having a magnetic head for writing or recording given data on the magnetic-record holding means of the ticket conveyed by the conveying means;

printing means for printing on the ticket conveyed by the conveying means in accordance with the given data;

manual-insertion passage means having at its one end an insertion opening into which a ticket is manually inserted from the outside, the other end of which being communicated with the conveying means;

side passage means having at its one end a side opening communicating with the conveying means between the ticket stock means and the magnetic recording means; and control means for controlling the conveying means so as to move, at first, the ticket, inserted into the insertion opening of the manual-insertion passage means from the outside, through the conveying means into the side passage means at the side opening, and, then, to move the ticket in the side passage means from the side passage means into the conveying means so that the given data is written or recorded on the magnetic-record holding means in the magnetic recording means, and further printed thereon in the printing means.

2. The ticket issuing apparatus according to claim 1, wherein gate means is provided at each of the other end of the manual-insertion passage means and the side opening of the side passage means, the gate means being movable between a closed position, in which the gate means closes each of the other end and the side opening, and an opening position, in which the gate means opens each of the other end and the side opening to the conveying means, the gate means provided at the other end of the manual-insertion passage means is urged toward the closed position and guides at its opening position the ticket, inserted into the manual-insertion passage means, toward the inside opening, and the gate means provided at the side opening of the side passage means is urged toward the opening position and guides at its opening position the ticket, moved from the manual-insertion passage means to the conveying means, into the side passage means at the side opening.

3. The ticket issuing apparatus according to claim 1, wherein the manual-insertion passage means includes:

insertion sensing means for sensing an insertion of the ticket from the outside into the insertion opening, sensing means for sensing the magnetic-record holding means of the ticket inserted into the insertion opening;

a closing lever movable between a closed position, in which the closing lever is located in a manual-insertion passage defined in the manual-insertion passage means so as to abut the ticket inserted into the insertion opening so that the ticket is prevented from further advancing into the manual-insertion passage means, and an opening position, in which the closing lever is moved away from the manual-insertion passage so as to allow the ticket inserted into the insertion opening to further advance therein; and closing-lever drive means for urging the closing lever toward the closed position, and moving the closing lever toward the opening position in accordance with the sensing of the magnetic-record holding means of the ticket, inserted into the insertion opening, by the sensing means for sensing the magnetic-record holding means.

4. The ticket issuing apparatus according to claim 1, wherein the magnetic recording means further has a monitoring magnetic head for monitoring a data written or recorded by the writing or recording magnetic head on the magnetic-record holding means of the ticket conveyed by the conveying means.

5. The ticket issuing apparatus according to claim 1, wherein the other end of the manual-insertion passage means communicates with the conveying means between the magnetic recording means and the printing means.

6. The ticket issuing apparatus according to claim 1, wherein the insertion opening of the manual-insertion passage means opens at a portion which is oppositely located in the apparatus with respect to the ticket stock means.

7. The ticket issuing apparatus according to claim 1, wherein a direction change lever is provided at the final end of a conveying path defined by the conveying means, the direction change lever changing the advancing direction of the ticket moved out from the final end.

8. The ticket issuing apparatus according to claim 1, wherein the conveying pass defined by the conveying means defines a conveying path which is curved downward in the downstream side of the magnetic recording means.

9. The ticket issuing apparatus according to claim 8, wherein the printing means is located along the downwardly-extending portion of the conveying path.

* * * * *